US006741038B2

(12) United States Patent
Heo

(10) Patent No.: US 6,741,038 B2
(45) Date of Patent: May 25, 2004

(54) PLASMA DISPLAY PANEL WITH PARTITION WALLS HAVING DIFFERENT WIDTHS

(75) Inventor: Eun-gi Heo, Cheonon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 181 days.

(21) Appl. No.: 09/960,500

(22) Filed: Sep. 24, 2001

(65) Prior Publication Data

US 2002/0041157 A1 Apr. 11, 2002

(30) Foreign Application Priority Data

Oct. 2, 2000 (KR) ..... 2000-57866

(51) Int. Cl.[7] ..... G09G 3/10; G09G 3/30; H01J 17/02

(52) U.S. Cl. ..... 315/169.3; 315/169.4; 345/76; 345/77; 345/60; 313/610; 313/609

(58) Field of Search ..... 315/169.4, 169.3, 315/169.1; 313/610, 609, 486, 484; 345/76, 77, 60, 63

(56) References Cited

U.S. PATENT DOCUMENTS 6,034,657 A 3/2000 Tokunaga et al. ..... 345/60
6,420,835 B1 * 7/2002 Chen et al. ..... 315/169.4
6,424,095 B1 * 7/2002 Hirao et al. ..... 315/169.4
6,498,430 B1 * 12/2002 Sakai et al. ..... 313/582
6,501,444 B1 * 12/2002 Yanagida et al. ..... 345/60
6,577,061 B2 * 6/2003 Sano et al. ..... 313/582

FOREIGN PATENT DOCUMENTS

| | | |
|---|---|---|
| EP | 0939420 | 9/1999 |
| EP | 1033740 | 9/2000 |
| EP | 1058284 | 12/2000 |
| JP | 10-241577 | 9/1998 |
| JP | 11-185631 | 7/1999 |
| JP | 2000-243298 | 9/2000 |
| KR | 1999-30025 | 2/2001 |

* cited by examiner

*Primary Examiner*—Tuyet T. Vo
(74) *Attorney, Agent, or Firm*—McGuireWoods LLP

(57) ABSTRACT

A plasma display panel in which partition walls are formed to have different widths includes a front substrate and a rear substrate facing the front substrate. The front substrate includes sustain electrodes, a dielectric layer that covers the sustain electrodes, and a protective layer formed on the bottom of the dielectric layer. The rear substrate includes a address electrodes, partition walls formed parallel to the address electrodes discharge spaces therebetween, the partition walls having corresponding different widths. Red, green and blue phosphor layers are deposited on the corresponding insides of adjacent pairs of the partition walls.

20 Claims, 9 Drawing Sheets

PLASMA DISPLAY PANEL WITH PARTITION WALLS HAVING DIFFERENT WIDTHS

CROSS-REFERENCE TO RELATED APPLICATIONS

This application claims the benefit of Korean Application No. 00-57866, filed Oct. 2, 2000, in the Korean Industrial Property Office, the disclosure of which is incorporated herein by reference.

BACKGROUND OF THE INVENTION

1. Field of the Invention

The present invention relates to a plasma display panel, and more particularly, to a plasma display panel in which widths of partition walls formed on a substrate are adjusted to be different to secure luminance uniformity.

2. Description of the Related Art

Typically, plasma display panels are image display apparatuses that display desired numbers, characters or graphics by discharging gas injected between two substrates having electrodes to produce ultraviolet rays, and to excite a phosphor layer using the ultraviolet rays produced from the discharge. Plasma display panels can be classified into a direct current (DC) type and an alternating current (AC) type according to a mode of applying a driving voltage to discharge cells (e.g., a discharge mode). Plasma display panels can be further classified into an opposite discharge type and a surface discharge type according to the configuration of the electrodes.

FIG. 1 shows a plasma display panel disclosed in Japanese Patent Publication No. hei 10-241577. Referring to FIG. 1, a plasma display panel 10 includes a front substrate 11 and a rear substrate 12 facing the front substrate 11. Sustain electrodes 13 are formed in a striped pattern on the bottom of the front substrate 11. The sustain electrode 13 is one of a common and scanning electrode, depending on the placement. Bus electrodes 15 are formed on the sustain electrodes 13 to reduce line resistance of the sustain electrodes 13. The bus electrodes 15 are formed of a metallic material having excellent conductivity. The electrodes 13 and 15 are covered with a first dielectric layer 16 on the front substrate 11. A protective layer 17 such as an oxide magnesium (MgO) film is formed on the bottom of the first dielectric layer 16.

Address electrodes 18 are formed on top of the rear substrate 12 and are orthogonal to the sustain electrodes 13. The address electrodes 18 may be covered with a second dielectric layer 19. A plurality of partition walls 100 are formed on top of the second dielectric layer 19. The inner sides of adjacent pairs of the partition walls 100 are coated with red, green and blue phosphor layers 110.

When a predetermined voltage is applied to a panel, the voltage waveform of each electrode 13 is sequentially driven starting from the periphery of the panel. The voltage waveform changes in a discharge space at the center of a substrate 11 due to a voltage drop that occurs due to the line resistance of the bus electrode 15. Accordingly, it is necessary to compensate for the voltage drop at the center of the substrate 11. Moreover, due to a change in a voltage waveform, the luminance is lower at the center of the substrate 11 than at the periphery thereof, resulting in nonuniformity of luminance.

To overcome these problems, the bus electrodes 15 in the plasma display panel 10 are formed to have different widths.

In other words, the width of the bus electrode 15 gradually increases (i.e., thickens) from the periphery of the front substrate 11 toward the center thereof so that the line resistance of the bus electrode 15 per unit length decreases from the periphery of the front substrate 11 toward the center thereof. Alternatively, the bus electrodes 15 may be formed to be thicker at the center of the front substrate 11, or may be formed of a material having low resistance.

However, the plasma display panel 10 has the following problems. Generally, the discharge voltage and the luminance are essential to the uniformity of a panel. The panel 10 has a uniform discharge voltage since the resistance of the bus electrode 15 per unit length decreases from the periphery of the front substrate 11 toward the center thereof. However, as the width of the bus electrode 15 formed of an opaque metallic material increases, the opening ratio of a corresponding discharge space decreases. In other words, by forming the bus electrodes 15 to have different widths in order to realize the uniform light emission of the panel 10, a discharge voltage increases from the periphery of the front substrate 11 toward the center so as to improve, which simultaneously decreases the opening ratio to thereby degrade the luminance.

SUMMARY OF THE INVENTION

To solve the above and other problems, it is an object of the present invention to provide a plasma display panel with partition walls having different widths on a substrate so as to enlarge a voltage margin and realize luminance uniformity.

Additional objects and advantages of the invention will be set forth in part in the description which follows and, in part, will be obvious from the description, or may be learned by practice of the invention.

To achieve the and other objects, a plasma display panel in which partition walls are formed to have different widths according to an embodiment of the present invention includes a front substrate, sustain electrodes formed in a striped pattern on a bottom of the front substrate, a bus electrode formed on a bottom of each sustain electrode, a dielectric layer formed on the bottom of the front substrate to cover the sustain and bus electrodes, a protective layer formed on a bottom of the dielectric layer, a rear substrate disposed opposite the front substrate, address electrodes formed on a top of the rear substrate to be orthogonal to the sustain electrodes, partition walls having different corresponding widths formed on the address electrodes in a direction parallel to the address electrodes to define discharge spaces between corresponding pairs of the partition walls, and red, green and blue phosphor layers deposited between corresponding pairs of the partition walls.

According to an aspect of the present invention, the plasma display panel further includes another dielectric layer formed to cover the address electrodes.

According to another aspect of the present invention, the width of each of the partition walls decreases from a periphery of the rear substrate toward a center in proportion to a voltage drop of the bus electrodes.

According to yet another aspect of the present invention, the discharge spaces gradually become narrower from the center of the rear substrate toward the periphery corresponding to a change in the width of each of the partition walls.

BRIEF DESCRIPTION OF THE DRAWINGS

The above and other objects and advantages of the present invention will become more apparent and more readily appreciated by describing in detail preferred embodiments thereof with reference to the accompanying drawings, in which.

DETAILED DESCRIPTION OF THE PREFERRED EMBODIMENTS

Figure 1:
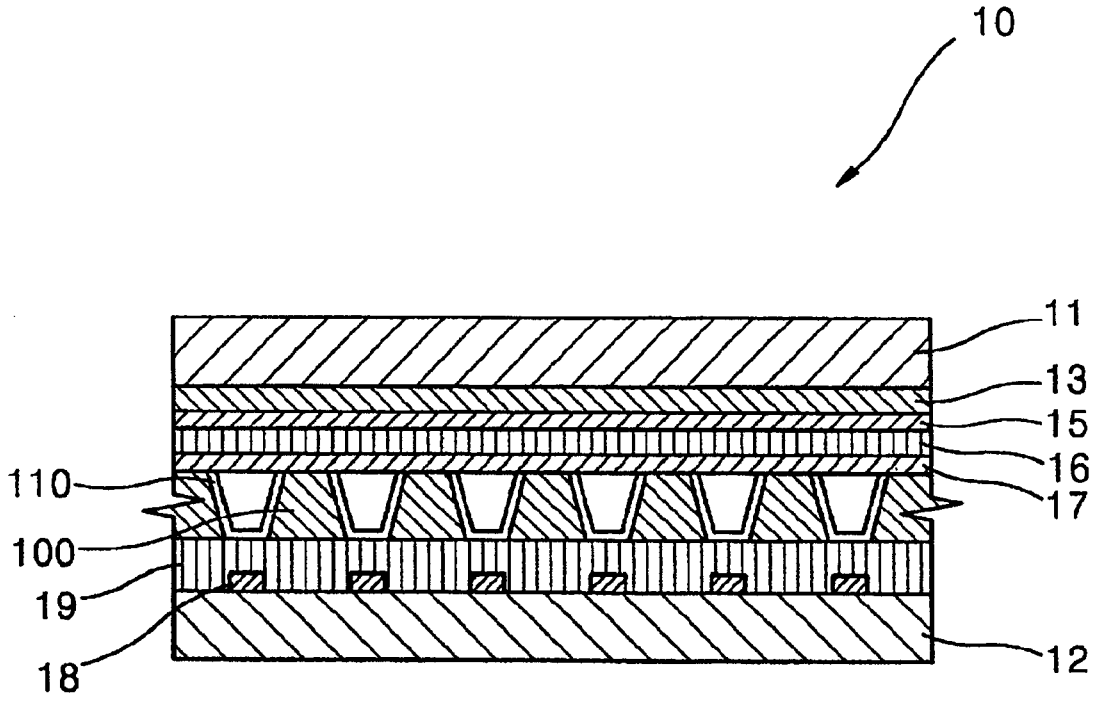
FIG. 1 (PRIOR ART)
FIG. 1 is a schematic sectional view of a conventional plasma display panel.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
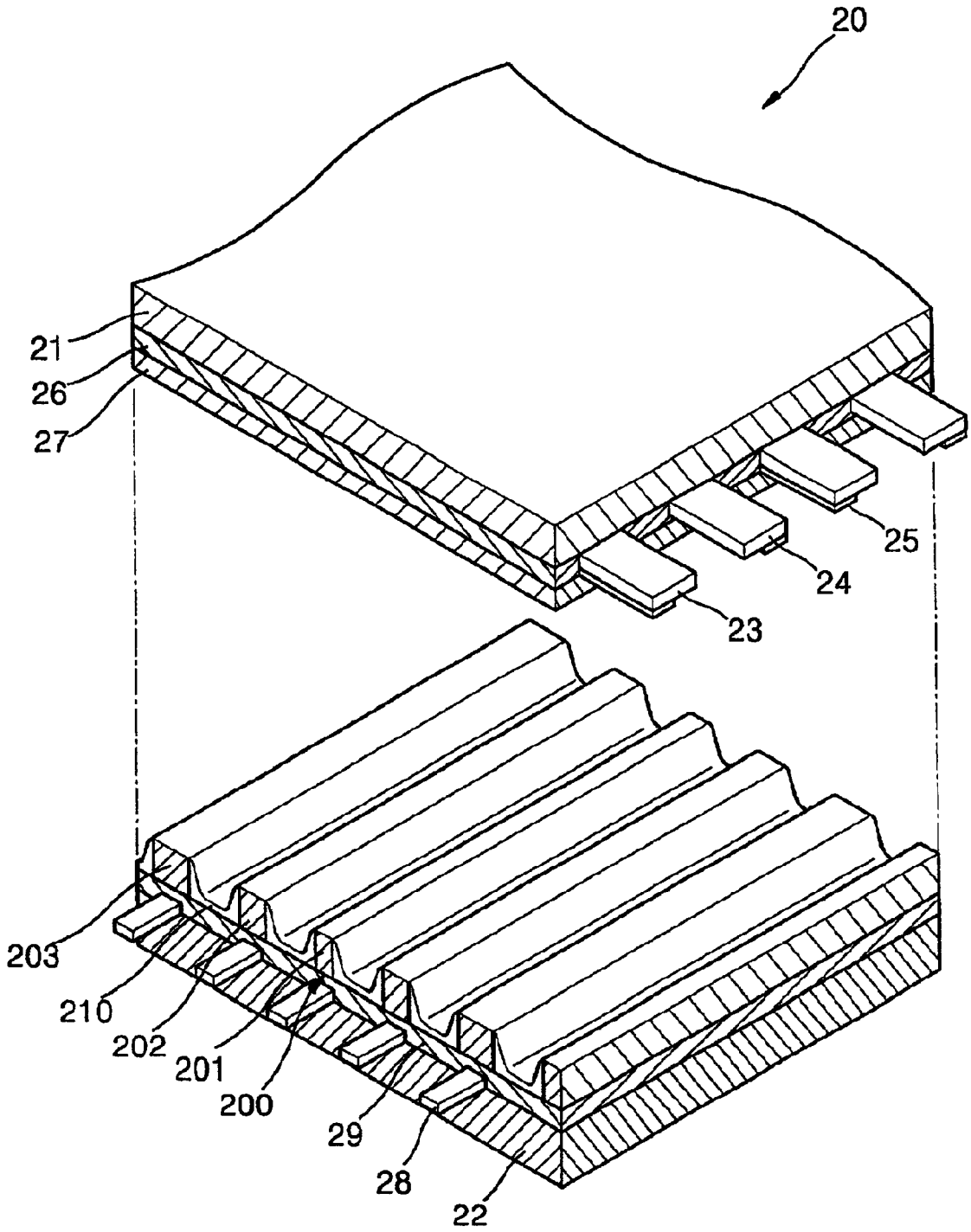
FIG. 2 is an exploded perspective view of a plasma display panel according to an embodiment of the present invention.

FIG. 2 shows a plasma display panel 20 according to an embodiment of the present invention. Referring to FIG. 2, the plasma display panel 20 includes a front substrate 21 and a rear substrate 22. Sustain electrodes (i.e., common electrodes) 23 and scan electrodes 24 are alternately formed in a striped pattern on a bottom of the front substrate 21. A bus electrode 25 is formed at one side on a bottom of each of the common and scan electrodes 23 and 24 in order to reduce the line resistance of the electrodes 23 and 24. The bus electrode 25 is formed of a metallic material and is narrower than the electrodes 23 and 24.

A transparent first dielectric layer 26 is formed on the front substrate 21 to entirely cover the common and scan electrodes 23 and 24 and bus electrodes 25. A protective layer 27, such as an oxide magnesium film, is formed on a bottom of the first dielectric layer 26 to protect the first dielectric layer 26.

Address electrodes 28 are formed on the rear substrate 22, which is disposed opposite the front substrate 21. The address electrodes 28 are formed in a striped pattern perpendicular to the common and scan electrodes 23 and 24. The address electrodes 28 are shown as covered with a second dielectric layer 29, but it is understood that the second dielectric layer 29 is not required in all circumstances.

Partition walls 200 are installed at predetermined intervals on top of the second dielectric layer 29. The partition walls 200 define discharge spaces between adjacent partition walls 200, and prevent cross talk between scan, address, and sustain electrodes 24, 28, 23. One of red, green and blue phosphor layers 210 is formed on the inside between each pair of adjacent partition walls 200. According to the present invention, the partition walls 200 have different widths. In other words, the widths of first, second and third partition walls 201, 202 and 203 gradually and sequentially increase from a minimum width at a center of the rear substrate 22 toward a maximum width at a the periphery thereof.

Figure 3:
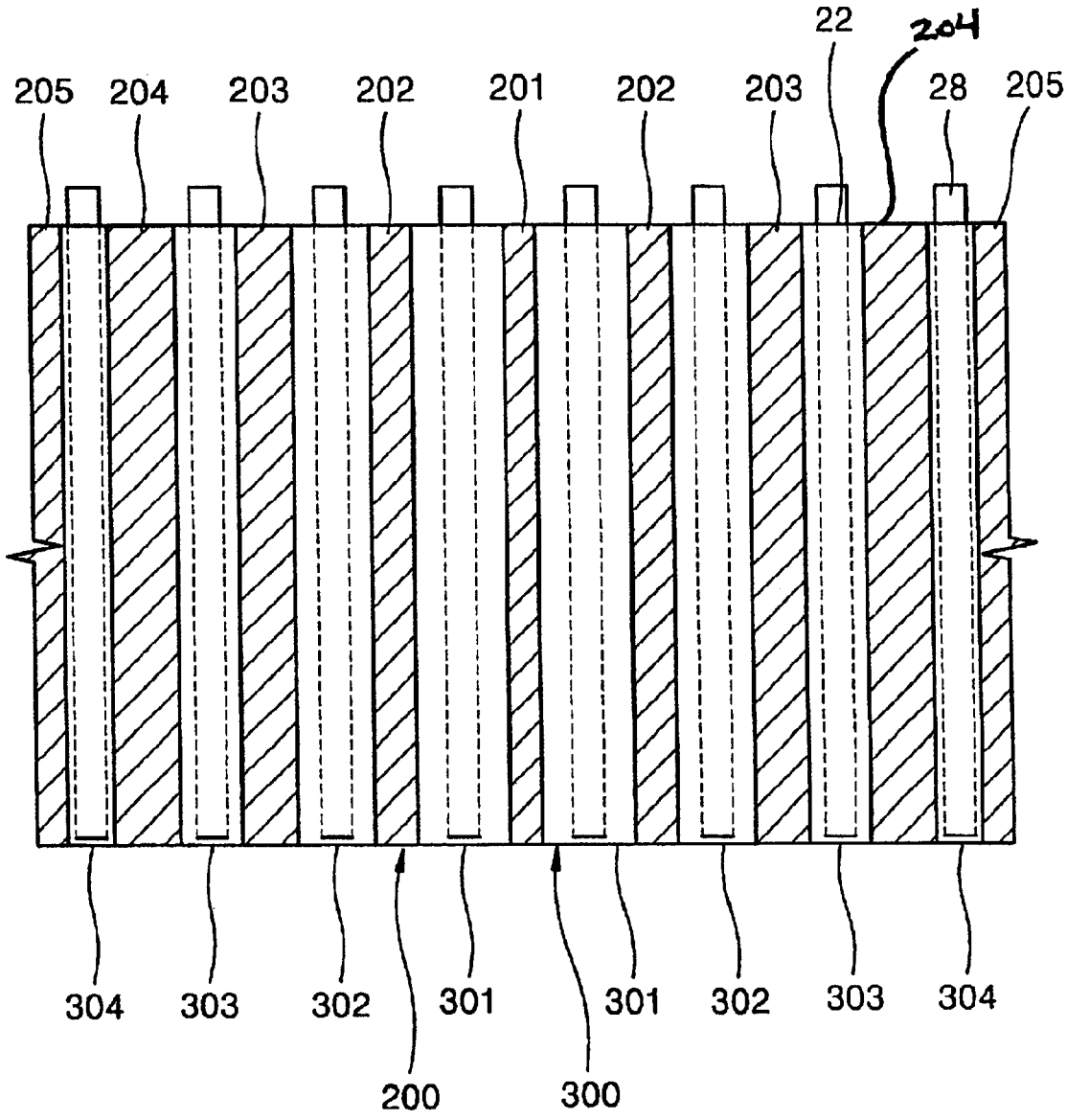
FIG. 3 is a schematic plan view of the rear substrate shown in FIG. 2 according to an embodiment of the present invention.

This change in width is shown in FIG. 3 in more detail. FIG. 3 shows only the address electrodes 28 and the partition walls 200, excluding the other members on the rear substrate 22 of the panel 20 of FIG. 2. The address electrodes 28 are formed on the rear substrate 22 spaced a predetermined distance apart in a striped pattern. The partition walls 200 having different widths are formed among the address electrodes in a direction parallel to the address electrodes 28. It is preferable that each partition wall 200 is narrow and high to secure a wide discharge space. In other words, it is advantageous to allow each partition wall 200 to have a large aspect ratio.

As shown in FIG. 3, the partition walls 200 are formed to be gradually narrower in proportion to a voltage drop from the periphery of the rear substrate 22 toward the center. In other words, the widths corresponding to the first, second, third, fourth and fifth partition walls 201, 202, 203, 204 and 205 starting from the center of the rear substrate 22 toward the periphery sequentially become wider.

Accordingly, an area of a first discharge space 301 formed between the first partition wall 201 and the second partition wall 202 is larger than an area of a second discharge space 302 formed between the second partition wall 202 and the third partition wall 203. The area of the second discharge space 302 is relatively larger than an area of a third discharge space 303 formed between the third partition wall 203 and the fourth partition wall 204. The area of the third discharge space 303 is relatively larger than an area of fourth discharge space 304 formed between the fourth partition wall 204 and the fifth partition wall 205.

As described above, the area of each discharge space 300 decreases from the center of the rear substrate 22 toward the periphery in response to an increase in the width of each partition wall 200. Accordingly, the area of the first discharge space 301 at the center of the substrate 22 is largest throughout the rear substrate 22, and the area of a discharge space 304 at the periphery of the rear substrate 22 is the smallest.

The operation of the plasma display panel 20 having the above structure will be described with reference to FIGS. 2 and 3. Once a predetermined voltage is applied between the scan electrode 24 and the address electrode 28 in the plasma display panel 20, pre-discharge occurs, which charges wall charges. In this state, once a voltage is applied between the common electrode 23 and the scan electrode 24, a glow discharge occurs to form a plasma. The plasma radiates ultraviolet rays that excite the phosphor layer 210, thereby displaying an image.

When discharging is maintained by provoking sustained discharge between the common and scan electrodes 23 and 24 while the address electrodes 28 are addressed by sequentially driving the scan electrodes 24 from the periphery of the substrate 21 toward the center, a voltage drop occurs due to the line resistance of the bus electrodes 25. As a result, a voltage waveform in a discharge space near the center of the panel 20 changes.

In an embodiment of the present invention, the discharge spaces 300 are formed to have different areas throughout the rear substrate 22 with regard to the voltage drop. In other words, as described above, the area of the first discharge space 301 at the center of the rear substrate 22 is the largest, and the other discharge spaces have areas gradually decreasing toward the periphery of the rear substrate 22. While the width of each partition wall 200 increases from the center of the rear substrate 22 toward the periphery, the area of each discharge space 300 increases from the periphery of the rear substrate 22 toward the center to compensate for a change in the voltage waveform due to the voltage drop.

The following description concerns the characteristics of a plasma display panel having the above structure, according to a change in a discharge cell pitch. In experiments, the voltage margin and optical characteristics of each monochromatic panel were measured at each cell pitch. Here, for the voltage margin, the operable range of a sustain-discharge voltage with respect to an address voltage and scan voltage margins sequentially applied to scan electrodes were estimated. In addition, only patterns corresponding to an operable range of 80% were used in order to exclude a weak discharge area at the edge of the panel.

Figure 4:
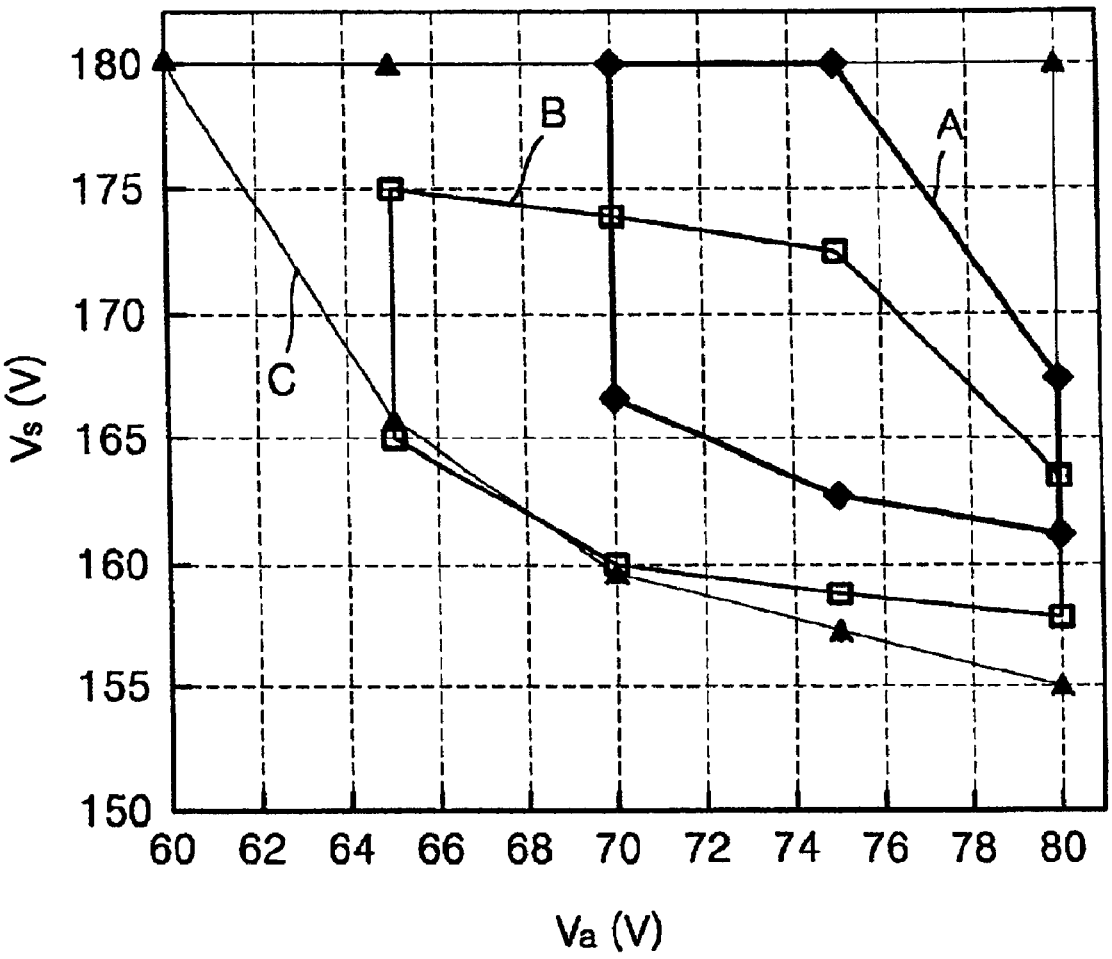
FIG. 4 is a graph of the operable range of a sustain-discharge voltage with respect to an address voltage in a red monochromatic panel according to an embodiment of the present invention.

FIG. 4 is a graph of the operable range of a sustain-discharge voltage with respect to an address voltage according to a first embodiment of the present invention. Referring to the graph, the X axis indicates an address voltage applied to an address electrode, and the Y axis indicates a sustain-discharge voltage. Here, a red monochromatic panel containing 30% phosphor was used. A scan voltage was −125 V, and a reset voltage during a reset step was 175 V.

As shown in FIG. 4, the operable range of the sustain-discharge voltage with respect to the address voltage increased as a cell pitch increased from 300 micrometers denoted by A, to 350 micrometers denoted by B, and to 430 micrometers denoted by C. The operable range also tended to move to a lower address voltage.

Figure 5:
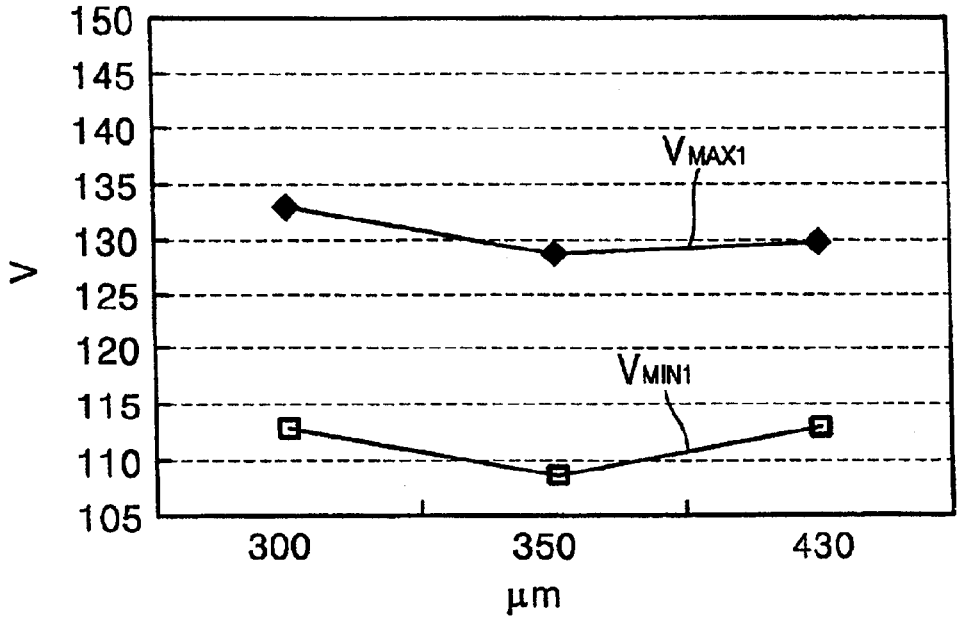
FIG. 5 is a graph of the operable range of a scan voltage with respect to a cell pitch in an embodiment of the panel shown in FIG. 4 according to the present invention.

FIG. 5 is a graph of the operable range of a scan voltage with respect to a change in the cell pitch in an address step in the red monochromatic panel. Referring to the graph, the X axis indicates the cell pitch, and the Y axis indicates a scan voltage applied to the scan electrode 24. Here, a sustain-discharge voltage was 170 V, an address voltage was 75 V, and a reset voltage was 175 V. As shown in FIG. 5, the difference between a maximum scan voltage $V_{MAX1}$ and a minimum scan voltage $V_{MIN1}$ does not significantly change even though the cell pitch increases from 300, to 350 and to 430 micrometers. In addition, the scan voltage tended to decrease as a whole.

Figure 6:
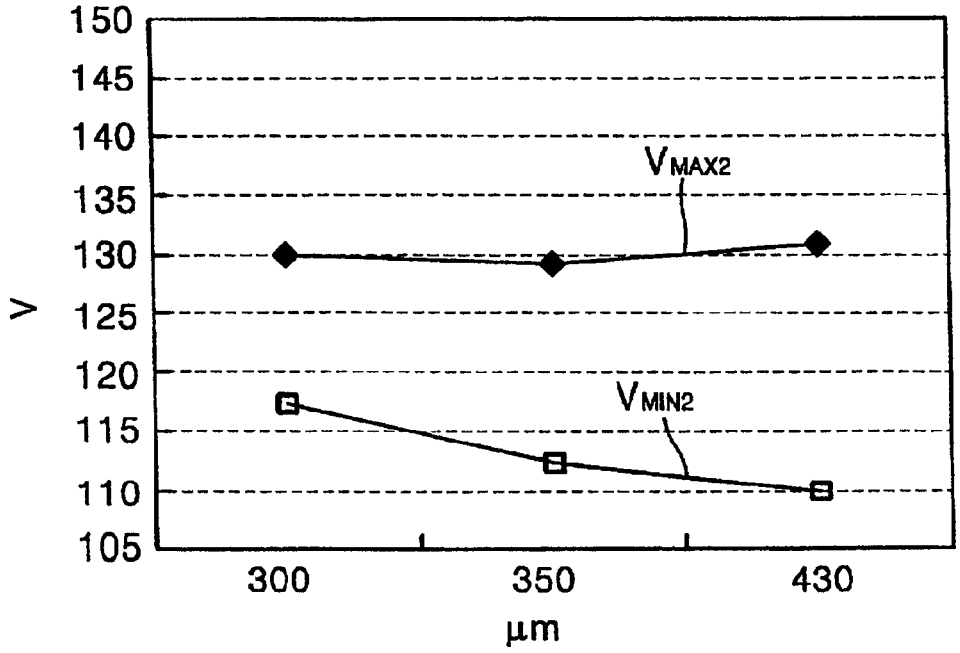
FIG. 6 is a graph of the operable range of a scan voltage with respect to a cell pitch in another embodiment of the panel shown in FIG. 4 according to the present invention.

FIG. 6 is a graph obtained under the same conditions as described in FIG. 5, with the exception that a sustain-discharge voltage was 175 V. Referring to FIG. 6, a minimum scan voltage $V_{MIN2}$ decreases as the cell pitch sequentially increases from 300, to 350 and to 430 micrometers. Accordingly, the difference between a maximum scan voltage $V_{MAX2}$ and a minimum scan voltage $V_{MIN2}$ increases as a cell pitch increases, so that an operable voltage range becomes wider.

Table 1 shows luminance and color coordinates according to a change in a cell pitch in the above red panel.

TABLE 1

| Cell pitch (μm) | 300 | 350 | 430 |
|---|---|---|---|
| Luminance (cd/m$^2$) | 138 | 167 | 204 |
| Color coordinate (X) | 0.653 | 0.653 | 0.653 |
| Color coordinate (Y) | 0.338 | 0.339 | 0.338 |

Referring to Table 1, when the cell pitch is 300 micrometers, the luminance is 138 cd/m$^2$. When the cell pitch is 350 micrometers, the luminance is 167 cd/m$^2$. When the cell pitch is 430 micrometers, the luminance is 204 cd/m$^2$. Accordingly, it can be concluded that the luminance increases as the cell pitch increases. That is, when the cell pitch increased by 10 micrometers, the luminance increased by about 3–4%. In contrast, the color coordinates X and Y scarcely change even though the cell pitch sequentially increases from 300, to 350 and to 430 micrometers.

Figure 7:
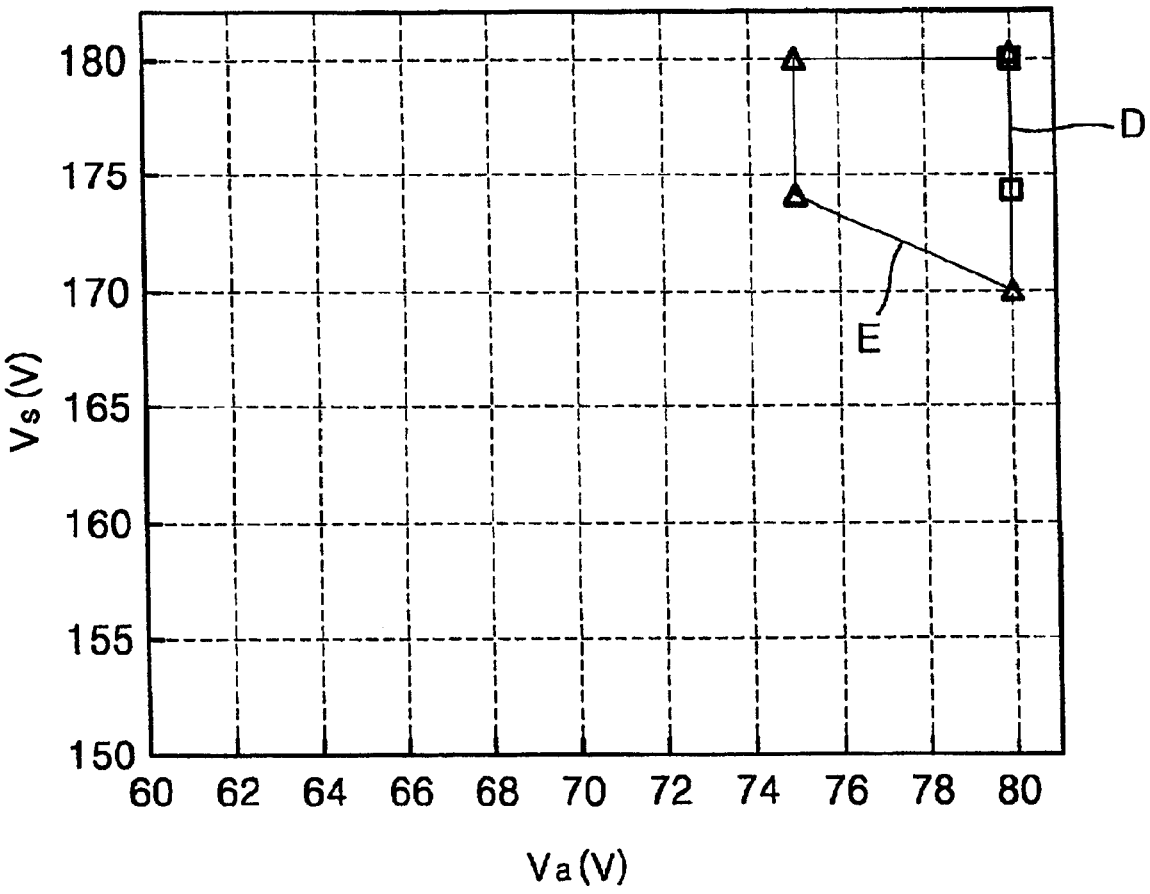
FIG. 7 is a graph of the operable range of a sustain-discharge voltage with respect to an address voltage in a green monochromatic panel according to another embodiment of the present invention.

FIG. 7 is a graph of the operable range of a sustain-discharge voltage with respect to an address voltage according to another embodiment of the present invention. Referring to FIG. 7, the X axis indicates an address voltage applied to an address electrode 28, and the Y axis indicates a sustain-discharge voltage. Here, the characteristics of a green monochromatic panel containing 40% phosphor when the cell pitch increases are shown. A scan voltage was −125 V, and a reset voltage during a reset step was 175 V.

As shown in FIG. 7, a driving voltage was very high as compared to a panel using a red or blue phosphor. When a cell pitch was 300 micrometers, the operable range of a sustain-discharge voltage with respect to an address voltage was beyond the range of the graph. As a cell pitch increased like 350 micrometers denoted by D and 430 micrometer denoted by E, the operable range of a sustain-discharge voltage with respect to an address voltage also increased. The operable range tended to move to a lower address voltage.

Figure 8:
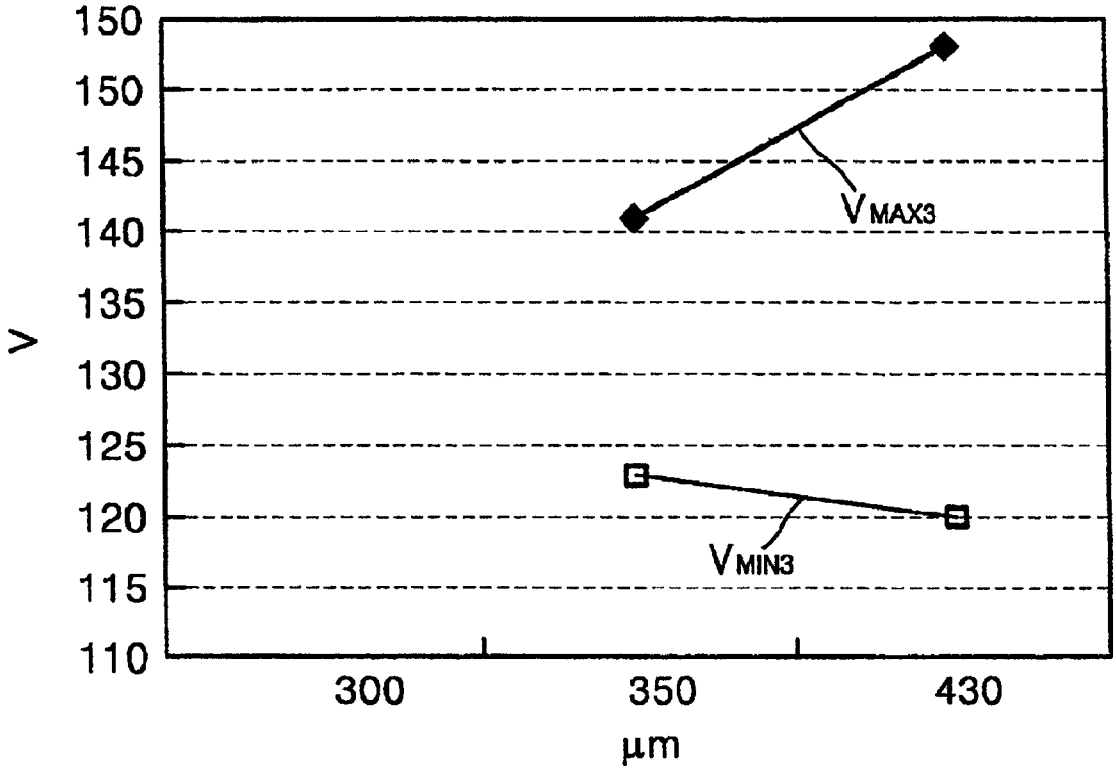
FIG. 8 is a graph of the operable range of a scan voltage with respect to a cell pitch in the panel shown in FIG. 7 according to an embodiment the present invention.

FIG. 8 is a graph of the operable range of a scan voltage with respect to a change in a cell pitch in an address step in the green monochromatic panel. Referring to the graph, the X axis indicates a cell pitch, and the Y axis indicates a scan voltage applied to the scan electrode 24. Here, a sustain-discharge voltage was 179 V, an address voltage was 79 V, and a reset voltage was 175 V. As shown in FIG. 8, the difference between a maximum scan voltage $V_{MAX3}$ and a minimum scan voltage $V_{MIN3}$ became larger as the cell pitch increased from 300, to 350 and to 430 micrometers, so an operable voltage range became wider.

Table 2 shows luminance and color coordinates according to a change in a cell pitch in the above green panel.

TABLE 2

| Cell pitch (μm) | 300 | 350 | 430 |
|---|---|---|---|
| Luminance (cd/m$^2$) | Out of range | 345 | 427 |
| Color coordinate (X) | | 0.248 | 0.248 |
| Color coordinate (Y) | | 0.694 | 0.693 |

Referring to Table 2, when a cell pitch is 300 micrometers, the operable range of a sustain-discharge voltage is out of the range of the graph. When the cell pitch is 350 micrometers, the luminance is 345 cd/m$^2$. When the cell pitch is 430 micrometers, the luminance is 427 cd/m$^2$. Accordingly, it can be concluded that the luminance increases as the cell pitch increases. That is, when the cell pitch increased by 10 micrometers, the luminance increased by about 3%. In contrast, the color coordinates X and Y scarcely change even though the cell pitch sequentially increases from 350 to 430 micrometers.

Figure 9:
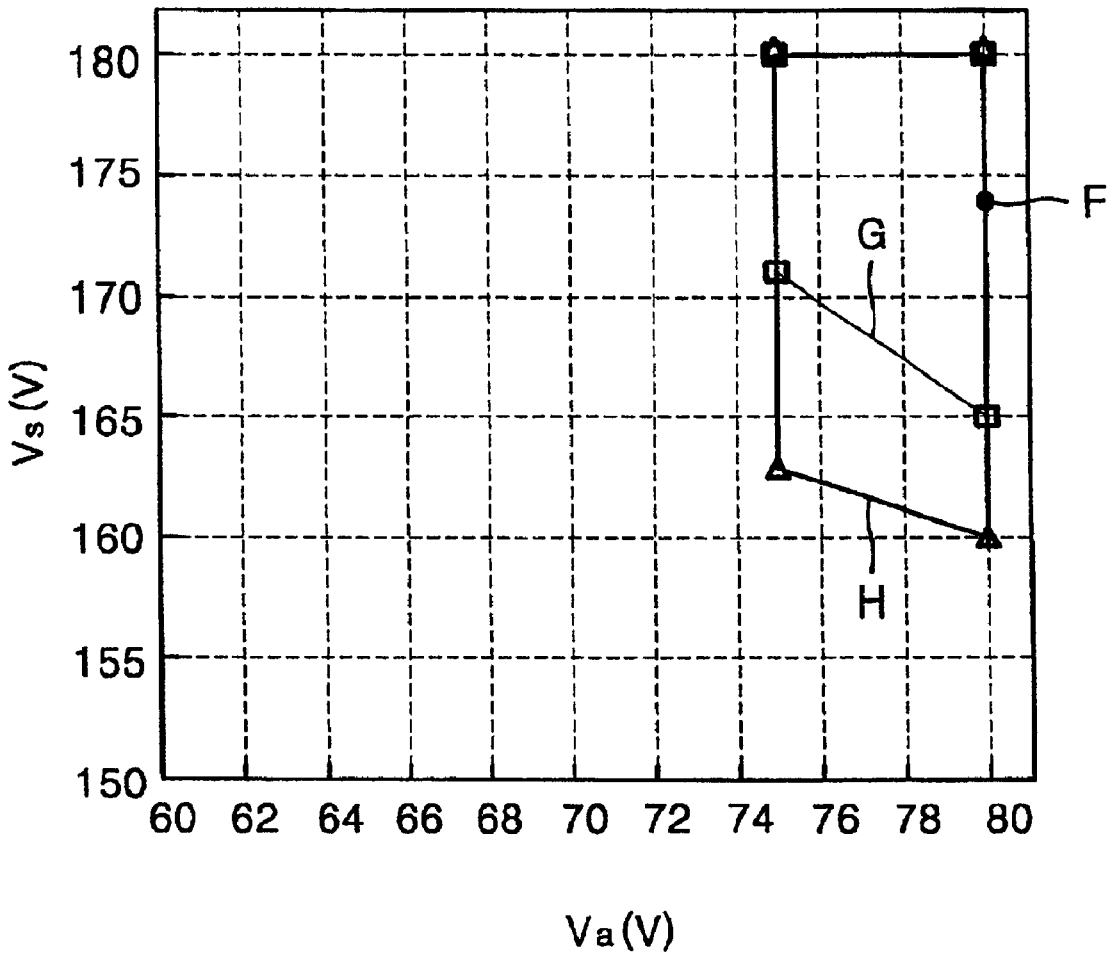
FIG. 9 is a graph of the operable range of a sustain-discharge voltage with respect to an address voltage in a blue monochromatic panel according to a further embodiment of the present invention.

FIG. 9 is a graph of the operable range of a sustain-discharge voltage with respect to an address voltage according to a further embodiment of the present invention. Referring to the graph, the X axis indicates an address voltage applied to the address electrode 28, and the Y axis indicates a sustain-discharge voltage. Here, a blue monochromatic panel containing 40% phosphor was used. A scan voltage was −125 V, and a reset voltage applied to a sustain electrode during a reset step was 175 V. As shown in FIG. 9, the operable range of the sustain-discharge voltage with respect to the address voltage increased as the cell pitch increased from 300 micrometers denoted by point F, to 350 micrometers denoted by line G, and to 430 micrometers denoted by line H. The operable range tended to move to a lower address voltage.

Figure 10:
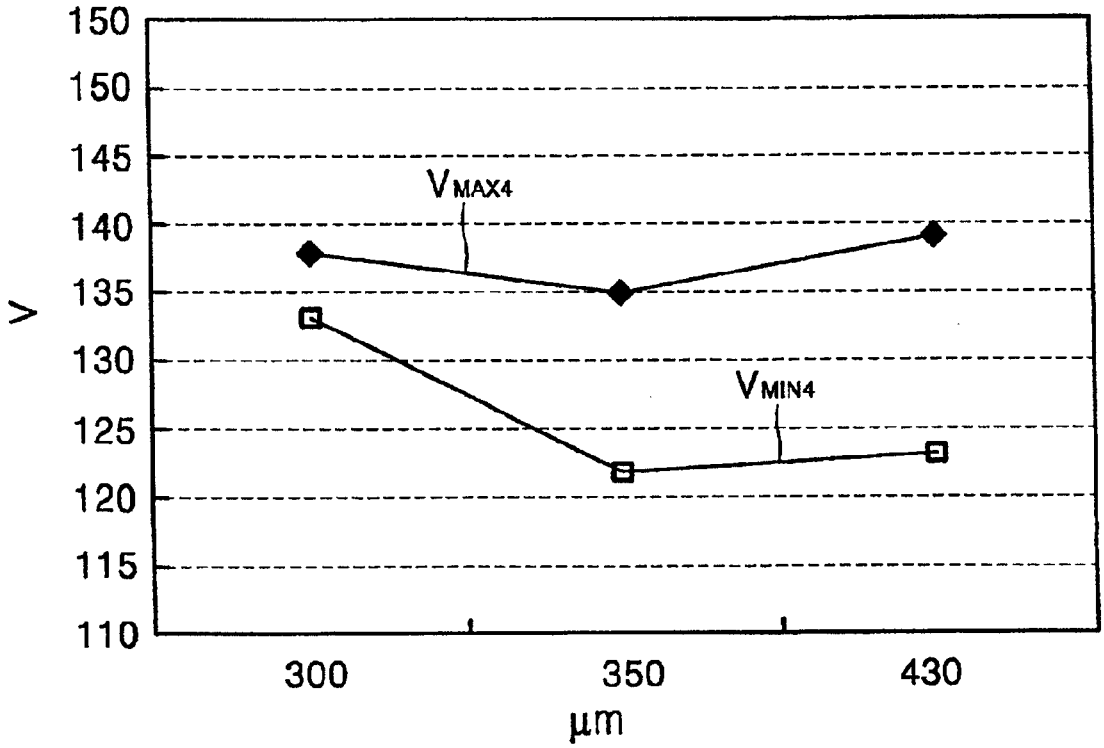
FIG. 10 is a graph of the operable range of a scan voltage with respect to a cell pitch in the panel shown in FIG. 9 according to an embodiment of the present invention.

FIG. 10 is a graph of the operable range of a scan voltage with respect to a change in a cell pitch in an address step in the blue monochromatic panel. Referring to the graph, the X axis indicates a cell pitch, and the Y axis indicates a scan voltage applied to a scan electrode 24. Here, a sustain-discharge voltage was 175 V, an address voltage was 75 V, and a reset voltage was 175 V. As shown in FIG. 10, a minimum scan voltage $V_{MIN4}$ generally decreases as the cell pitch sequentially increases from 300, to 350 and to 430 micrometers. Accordingly, the difference between a maximum scan voltage $V_{MAX4}$ and a minimum scan voltage $V_{MIN4}$ increases as a cell pitch increases, so an operable voltage range becomes wider. However, when the cell pitch steeply increases from 350 to 430 micrometers, the minimum scan voltage $V_{MIN4}$ scarcely changes, so that the operable voltage range also scarcely changes.

Table 3 shows luminance and color coordinates according to a change in a cell pitch in the above blue panel.

TABLE 3

| Cell pitch (μm) | 300 | 350 | 430 |
|---|---|---|---|
| Luminance (cd/m$^2$) | 78 | 82 | 107 |
| Color coordinate (X) | 0.167 | 0.164 | 0.165 |
| Color coordinate (Y) | 0.109 | 0.108 | 0.108 |

Referring to Table 3, when the cell pitch is 300 micrometers, the luminance is 78 cd/m$^2$. When the cell pitch is 350 micrometers, the luminance is 82 cd/m$^2$. When the cell pitch is 430 micrometers, the luminance is 107 cd/m$^2$. Accordingly, it can be concluded that the luminance increases as the cell pitch increases. That is, when the cell pitch increased by 10 micrometers, the luminance increased by about 1–4%. In contrast, the color coordinates X and Y scarcely change even though the cell pitch sequentially increases from 300, to 350 and to 430 micrometers.

As described above, a plasma display panel in which partition walls have different widths according to the present invention has the following effects. First, since only the width of a partition wall on a substrate decreases from the periphery of the substrate toward the center, a discharge space is relatively wider, thereby compensating for the voltage drop due to the line resistance of the discharge electrodes. Second, since an applied discharge voltage increases toward the center of the panel, and simultaneously, the opening ratio of a discharge space increases, the luminance is improved. Third, the uniformity of the luminance can be secured by adjusting a discharge space by changing the width of a partition wall. Fourth, since a discharge space increases toward the center of the panel, the amount of deposited phosphor also increases, thereby increasing the luminance. Fifth, the partition walls can be formed by just adjusting the width of a mask having a pattern corresponding to partition walls, thereby facilitating manufacture.

While the above invention has been described in reference to an AC-type plasma display panel, it is understood that the invention could also be applied to other types of plasma display panels, such as DC-type plasma display panels.

While this invention has been particularly shown and described with reference to preferred embodiments thereof, it will be understood by those skilled in the art that various changes in form and details may be made therein. Therefore, the true technical scope of the invention will be defined by the claims and equivalents thereof.

What is claimed is:

1. A plasma display panel comprising:

a front substrate;

sustain and scan electrodes formed in a striped pattern on a bottom of said front substrate;

a bus electrode formed on a bottom of each said sustain and scan electrodes;

a dielectric layer formed on a bottom of said front substrate to cover said sustain, scan, and bus electrodes;

a protective layer formed on a bottom of said dielectric layer;

a rear substrate disposed opposite said front substrate;

address electrodes formed on a top of said rear substrate to be orthogonal to said sustain electrodes;

partition walls formed on said address electrodes parallel to said address electrodes, adjacent pairs of said partition walls defining discharge spaces, and ones of said partition walls having different corresponding widths, wherein the width of each of said partition walls decreases from a periphery of said rear substrate toward a center of said rear substrate; and red, green and blue phosphor layers deposited on corresponding insides of pairs of said partition walls.

2. The plasma display panel of claim 1, further comprising another dielectric layer to cover said address electrodes.

3. The plasma display panel of claim 2, wherein the width of each of said partition walls decreases from a periphery of said rear substrate toward a center of said rear substrate in proportion to a voltage drop experienced by said bus electrodes.

4. The plasma display panel of claim 2, wherein the discharge spaces gradually become narrower from a center of said rear substrate toward a periphery of said rear substrate corresponding to a change in the width of each of said partition walls.

5. A plasma display panel comprising:

a first substrate and a second substrate;

first electrodes disposed on said first substrate in a first direction;

a dielectric layer disposed on said first substrate to cover said first electrodes;

a protective layer formed on a bottom of said dielectric layer;

second electrodes disposed on said second substrate opposite said first electrodes in a second direction non-parallel with the first direction;

partition walls disposed between said second electrodes and said first electrodes, wherein said partition walls are disposed in the second direction and adjacent pairs of said partition walls define discharge spaces therebetween, ones of the discharge spaces having different areas that increase from a periphery of said rear substrate toward a center of said rear substrate; and phosphor layers disposed in corresponding pairs of said partition walls.

6. The plasma display panel of claim 5, wherein:

said first electrodes further comprise corresponding bus electrodes, and the areas of ones of the discharge spaces change in accordance with a voltage drop experienced by ones of the bus electrodes due to line resistance during operation of the plasma display panel.

7. The plasma display panel of claim 5, wherein the areas of ones of the discharge spaces change in accordance with a distance of the corresponding pairs of said partition walls from a center of said second substrate.

8. The plasma display panel of claim 7, wherein the areas of each of the discharge spaces decrease in accordance with the distance from the center.

9. The plasma display panel of claim 5, wherein:

said first electrodes further comprise corresponding bus electrodes, and widths of ones of said partition walls change in accordance with a voltage drop experienced by ones of the bus electrodes due to line resistance during operation of the plasma display panel.

10. The plasma display panel of claim 5, wherein widths of ones of said partition walls change in accordance with a distance of said partition walls from a center of said second substrate.

11. The plasma display panel of claim 10, wherein the widths of each of said partition walls increase in accordance with the distance of said partition walls from the center of said second substrate.

12. The plasma display panel of claim 11, further comprising another dielectric layer disposed on said second substrate to cover the address electrodes, and wherein said partition walls are disposed on said another dielectric layer, and said second electrodes comprise address electrodes disposed between corresponding adjacent pairs of said partition walls.

13. A plasma display panel comprising:

a first substrate and a second substrate;

first electrodes disposed on said first substrate in a first direction, said first electrodes including corresponding bus electrodes;

a dielectric layer disposed on said first substrate to cover said first electrodes;

a protective layer formed on a bottom of said dielectric layer;

second electrodes disposed on said second substrate opposite said first electrodes in a second direction non-parallel with the first direction;

partition walls disposed between said second electrodes and said first electrodes, where said partition walls are disposed in the second direction and adjacent pairs of said partition walls define discharge spaces therebetween; and phosphor layers disposed in corresponding discharge spaces, wherein a luminescence of the plasma display panel is maintained while increasing an opening ratio of the discharge spaces as the discharge spaces approach a center of said second substrate to account for a voltage drop in ones of the bus electrodes of said first electrodes due to line resistance during operation of the plasma display panel.

14. The plasma display panel of claim 13, wherein an amount of phosphor in ones of said phosphor layers changes as a function of a proximity of said phosphor layer to the center of said second substrate.

15. The plasma display panel of claim 14, wherein the amount of the phosphor in each of said phosphor layers increases as the function of the proximity of said phosphor layer to the center of said second substrate.

16. A rear plate for use in a plasma display panel, comprising:

a substrate;

electrodes disposed on said substrate in a direction;

partition walls disposed on said substrate in the direction to define discharge spaces therebetween; and phosphor layers disposed in corresponding discharge spaces, wherein at least three of the partition walls have different widths which decrease from a periphery of said substrate toward a center of said substrate.

17. The rear plate of claim 16, wherein the widths of ones of said partition walls change to increase areas of corresponding discharge spaces as a function of a proximity of the discharge space to a center of said substrate.

18. The rear plate of claim 17, wherein the widths of each said partition walls decrease the closed said partition walls are to the center.

19. A plasma display panel, comprising:

a first substrate;

a second substrate arranged above the first substrate;

address electrodes formed on the first substrate;

partition walls formed on the first substrate, wherein an area between adjacent partition walls defines discharge spaces;

a first discharge space having a first width;

a second discharge space adjacent the first discharge space having a second width;

a third discharge space adjacent the second discharge space having a third width, wherein the first width is smaller than the second width and the first width is smaller than the third width.

20. The plasma display panel of claim 19, wherein a size of the first width and the second width are formed to compensate for a change in a voltage waveform due to a voltage drop.

* * * * *